US011759851B2

(12) United States Patent
Irie et al.

(10) Patent No.: US 11,759,851 B2
(45) Date of Patent: Sep. 19, 2023

(54) METHOD FOR CONTINUOUSLY CASTING STEEL

(71) Applicant: JFE STEEL CORPORATION, Tokyo (JP)

(72) Inventors: Shuhei Irie, Tokyo (JP); Satoshi Ueoka, Tokyo (JP); Hirokazu Sugihara, Tokyo (JP); Hiroyuki Fukuda, Tokyo (JP); Norichika Aramaki, Tokyo (JP); Akitoshi Matsui, Tokyo (JP); Kenichi Osuka, Tokyo (JP); Sho Kokufu, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 17/600,899

(22) PCT Filed: Mar. 27, 2020

(86) PCT No.: PCT/JP2020/013885

§ 371 (c)(1),
(2) Date: Oct. 1, 2021

(87) PCT Pub. No.: WO2020/203715

PCT Pub. Date: Oct. 8, 2020

(65) Prior Publication Data

US 2022/0152694 A1 May 19, 2022

(30) Foreign Application Priority Data

Apr. 2, 2019 (JP) ..... 2019-070518

(51) Int. Cl.
*B22D 11/124* (2006.01)
*B22D 11/14* (2006.01)

(52) U.S. Cl.
CPC ..... *B22D 11/124* (2013.01); *B22D 11/142* (2013.01)

(58) Field of Classification Search
CPC ..... B22D 11/124; B22D 11/14; B22D 11/142
USPC ..... 164/486, 444
See application file for complete search history.

(56) References Cited

FOREIGN PATENT DOCUMENTS

| | | | |
|---|---|---|---|
| CN | 101678447 | A | 3/2010 |
| EP | 2 165 788 | A1 | 3/2010 |
| EP | 3 488 947 | A1 | 5/2019 |
| JP | H07-1096 | A | 1/1995 |

(Continued)

OTHER PUBLICATIONS

Apr. 29, 2022 Office Action issued in Russian Patent Application No. 2021128610.

(Continued)

*Primary Examiner* — Kevin P Kerns
(74) *Attorney, Agent, or Firm* — Oliff PLC

(57) ABSTRACT

A method for continuously casting steel capable of reducing center segregation that occurs in a slab. In a section in a continuous casting machine in a slab withdrawal direction, a section from a start point at which the average value of solid phase ratios along a thickness direction at a widthwise center of a slab is within a range of 0.4 or more and 0.8 or less to an end point at which the average value of solid phase ratios along the thickness direction at the widthwise center of the slab is greater than the average value of solid phase ratios at the start point and is 1.0 or less is set as a first section. The slab is cooled by water in the first section at a water flow rate per surface area of the slab within a range of 50 L/($m^2$×min) or more and 2,000 L/($m^2$×min) or less.

8 Claims, 8 Drawing Sheets

(56) References Cited

FOREIGN PATENT DOCUMENTS

| | | | |
|---|---|---|---|
| JP | H08-132203 | A | 5/1996 |
| JP | H08-192256 | A | 7/1996 |
| JP | H08-224650 | A | 9/1996 |
| JP | 2001-62550 | A | 3/2001 |
| JP | 2008-100249 | A | 5/2008 |
| JP | 2009-297756 | A | 12/2009 |
| JP | 2012-110898 | A | 6/2012 |
| JP | 2013-244492 | A | 12/2013 |
| JP | 2016-28827 | A | 3/2016 |
| RU | 2 185 927 | C2 | 7/2002 |
| RU | 2 422 242 | C2 | 6/2011 |
| RU | 2 564 192 | C1 | 9/2015 |
| SU | 508331 | A1 | 3/1976 |
| TW | 201813740 | A | 4/2018 |

OTHER PUBLICATIONS

Aug. 24, 2022 Office Action issued in Chinese Patent Application No. 202080026097.7.
Jun. 16, 2020 International Search Report issued in International Patent Application No. PCT/JP2020/013885.
Nov. 24, 2020 Office Action issued in Taiwanese Patent Application No. 109110943.
Aug. 20, 2021 Office Action issued in Taiwanese Patent Application No. 109110943.
Sep. 7, 2021 Office Action issued in Japanese Patent Application No. 2020-556823.
Mar. 31, 2022 Search Report issued in European Patent Application No. 20782580.3.
Jan. 30, 2023 Office Action issued in Korean Patent Application No. 10-2021-7031360.
Aug. 1, 2023 Office Action issued in Korean Patent Application No. 10-2021-7031360.

METHOD FOR CONTINUOUSLY CASTING STEEL

TECHNICAL FIELD

The present disclosure relates to a method for continuously casting steel. More specifically, the disclosed embodiments relate to a method for continuously casting steel capable of reducing center segregation that occurs in a slab.

BACKGROUND

In a solidification process of steel, solute elements such as carbon, phosphorus, sulfur, and manganese are concentrated on an unsolidified liquid phase side by redistribution when the steel solidifies. As a result, microsegregation occurs between dendrite arms.

In addition, in a continuously cast slab that is formed through casting using a continuous casting machine and that is in the process of solidifying (hereinafter also simply referred to as "slab"), a void may sometimes be formed in a thicknesswise center portion of the slab, or a negative pressure may sometimes be generated in the thicknesswise center portion of the slab due to solidification shrinkage, heat shrinkage, bulging of a solidified shell that occurs between rolls of the continuous casting machine, or the like. As a result, molten steel is drawn into the thicknesswise center portion of the slab. However, there is not a sufficient amount of molten steel in an unsolidified layer at the end of solidification, and thus, the molten steel that is present between dendrite arms and in which the above-mentioned solute elements are concentrated moves in such a manner as to be drawn into the thicknesswise center portion of the slab and solidifies in the thicknesswise center portion of the slab. In a segregation spot formed in the manner described above, the concentrations of the solute elements are significantly higher than the initial concentrations of the solute elements in the molten steel. This phenomenon is generally called "microsegregation" and is also called "center segregation" because of the location where this phenomenon occurs.

Center segregation of slabs significantly reduces the quality of the material of line pipes used for transportation of crude oil, natural gas, or the like. For example, hydrogen that has entered the inside of steel due to corrosion reaction diffuses and accumulates around manganese sulfide (MnS) or niobium carbide (NbC) generated in a portion where center segregation has occurred, and cracks are generated due to the internal pressure, so that quality deterioration such as that mentioned above is caused. In addition, the portion where the center segregation has occurred is hardened because of high concentrations of solute elements, and thus, the above-mentioned cracks further propagate and extend to the peripheral portions. These cracks are called hydrogen induced cracking (HIC). Thus, it is extremely important to reduce center segregation that occurs in a thicknesswise center portion of a slab in order to improve the quality of a steel product.

In the related art, a large number of technologies for reducing center segregation that occurs in a slab or making center segregation that occurs in a slab harmless during the period from a continuous casting process to a rolling process. For example, Patent Literature 1 and Patent Literature 2 each propose a technology for casting, in a continuous casting machine, a slab that has an unsolidified layer and that is at the end of solidification while gradually rolling the slab by using slab support rolls by a rolling reduction amount that is substantially equivalent to the sum of a solidification shrinkage amount and a heat shrinkage amount so as to reduce the thickness of the slab. This technique is called a soft reduction method. In the soft reduction method, when a slab is pulled out by using pairs of slab support rolls that are arranged in a casting direction, the slab is gradually rolled and reduced in thickness by a rolling reduction amount commensurate with the sum of a solidification shrinkage amount and a heat shrinkage amount so as to reduce the volume of an unsolidified layer, and formation of a void and a negative pressure portion in a center portion of the slab is prevented. As a result, the concentrated molten steel between dendrite arms is prevented from being drawn into the thicknesswise center portion of the slab. With such a mechanism, center segregation that occurs in the slab is reduced by the soft reduction method.

In addition, it is known that there is a close relationship between the form of the microstructure of dendrite in a thicknesswise center portion and center segregation. For example, Patent Literature 3 proposes a technology for facilitating refinement and equiaxed crystallization of a solidification microstructure by setting a specific water rate in a casting direction at a certain position in a secondary cooling zone of a continuous casting machine to 0.5 L/kg or greater and reducing center segregation. Patent Literature 4 proposes a technology for reducing center segregation by appropriately adjusting rolling reduction conditions and cooling conditions so as to set a dendrite primary arm spacing in a thicknesswise center portion of a slab to 1.6 mm or smaller.

In contrast, as a method of controlling the temperature of a slab in a continuous casting machine, Patent Literature 5 proposes a technology for heating and raising the temperature of a surface of a slab, and this technology is actually aimed at preventing surface cracking of a slab. In Patent Literature 5, surface cracking is prevented from occurring during straightening of a slab by heating a surface layer of the slab at an average temperature of 30° C./min or greater in a straightening zone of a continuous casting machine.

CITATION LIST

Patent Literature

PTL 1: Japanese Unexamined Patent Application Publication No. 8-132203

PTL 2: Japanese Unexamined Patent Application Publication No. 8-192256

PTL 3: Japanese Unexamined Patent Application Publication No. 8-224650

PTL 4: Japanese Unexamined Patent Application Publication No. 2016-28827

PTL 5: Japanese Unexamined Patent Application Publication No. 2008-100249

SUMMARY

Technical Problem

In the invention described in Patent Literature 1 and the invention described in Patent Literature 2, center segregation can be reduced by soft reduction. However, the invention described in Patent Literature 1 and the invention described in Patent Literature 2 are not sufficient to reduce center segregation to a level that has been recently required for steel pipes such as line pipe materials.

In the invention described in Patent Literature 3 and the invention described in Patent Literature 4, refinement of a solidification microstructure is caused by performing adjustment of secondary cooling conditions in addition to soft reduction, and center segregation can be reduced. However, the level of reduction in segregation, the level being required for steel pipes such as line pipe materials, has been increasing year-by-year, and the invention described in Patent Literature 3 and the invention described in Patent Literature 4 are not sufficient to achieve a level of reduction in segregation that will be required in the future. In addition, in order to further reduce segregation, for example, continuous casting of steel under an optimum soft reduction condition may be considered, and it is difficult to achieve a further reduction of segregation than that in the present by the method described in Patent Literature 3 or the method described in Patent Literature 4.

The slab heating device described in Patent Literature 5 has a limited installation space in a continuous casting machine, and thus, the slab heating device is not capable of controlling the entire slab to a uniform temperature even though the slab heating device can be used as local heating means.

The disclosed embodiments have been made in view of these problems, and it is an object of the disclosed embodiments to provide a method for continuously casting steel capable of reducing center segregation that occurs in a slab.

Solution to Problem

The inventors of the disclosed embodiments conducted extensive studies in order to solve the above problems. As a result, the inventors of the disclosed embodiments discovered that, in a cooling process of a slab in continuous casting of steel, center segregation can be reduced to a large extent by cooling the slab in a predetermined section at a predetermined water flow rate, and accordingly, the disclosed embodiments have been made.

The disclosed embodiments have been made on the basis of the above-mentioned knowledge, and the disclosed embodiments are as follows.

[1] A method for continuously casting steel in which, in a section in a continuous casting machine along a slab withdrawal direction, a section from a start point at which an average value of solid phase ratios along a thickness direction at a widthwise center of a slab is within a range of 0.4 or more and 0.8 or less to an end point at which an average value of solid phase ratios along the thickness direction at the widthwise center of the slab is greater than the average value of solid phase ratios at the start point and is 1.0 or less is set as a first section, and the slab is cooled by water in the first section at a water flow rate per surface area of the slab within a range of 50 L/($m^2$×min) or more and 2,000 L/($m^2$×min) or less.

[2] In the method for continuously casting steel described in the above [1], the slab is cooled by water in the first section at a water flow rate per surface area of the slab within a range of 300 L/($m^2$×min) or more and 1,000 L/($m^2$×min) or less.

[3] In the method for continuously casting steel described in the above [1] or the above [2], the average value of solid phase ratios at the end point of the first section is less than 1.0, and a section that is positioned further downstream than the first section and that has a predetermined length is set as a second section, and the slab is cooled by water in the second section at a water flow rate per surface area of the slab smaller than the water flow rate per surface area of the slab in the first section.

[4] In the method for continuously casting steel described in the above [3], the slab is cooled by water in the second section at a water flow rate per surface area of the slab within a range of 50 L/($m^2$×min) or more and 300 L/($m^2$×min) or less.

[5] In the method for continuously casting steel described in the above [3] or the above [4], in the second section, a surface temperature of the slab is 200° C. or lower.

[6] In the method for continuously casting steel described in any one of the above [1] to the above [5], the first section is located in a region of a horizontal zone in which the slab is transported in a horizontal direction in the continuous casting machine.

[7] In the method for continuously casting steel described in any one of the above [1] to the above [6], in a section that is a region spaced apart by 5 m or more on the downstream side from a lower end of a mold of the continuous casting machine along a slab withdrawal path line and that is a section extending at least 5 m or more toward an upstream side from a position between rolls adjacent to an upstream side of a start point of the first section, cooling of the slab is performed without spraying a secondary cooling water onto the slab, and when a full width of the slab is W (from −0.5 W through widthwise center 0 to +0.5 W), a difference between a maximum value and a minimum value of the surface temperature of the slab within a range of 0.8 W (from −0.4 W through widthwise center 0 to +0.4 W) of the width of the slab between the rolls adjacent to the upstream side of the start point of the first section is 150° C. or less.

Advantageous Effects

In the method for continuously casting steel according to the disclosed embodiments, center segregation that occurs in a slab can be reduced.

DESCRIPTION OF EMBODIMENTS

Figure 1:
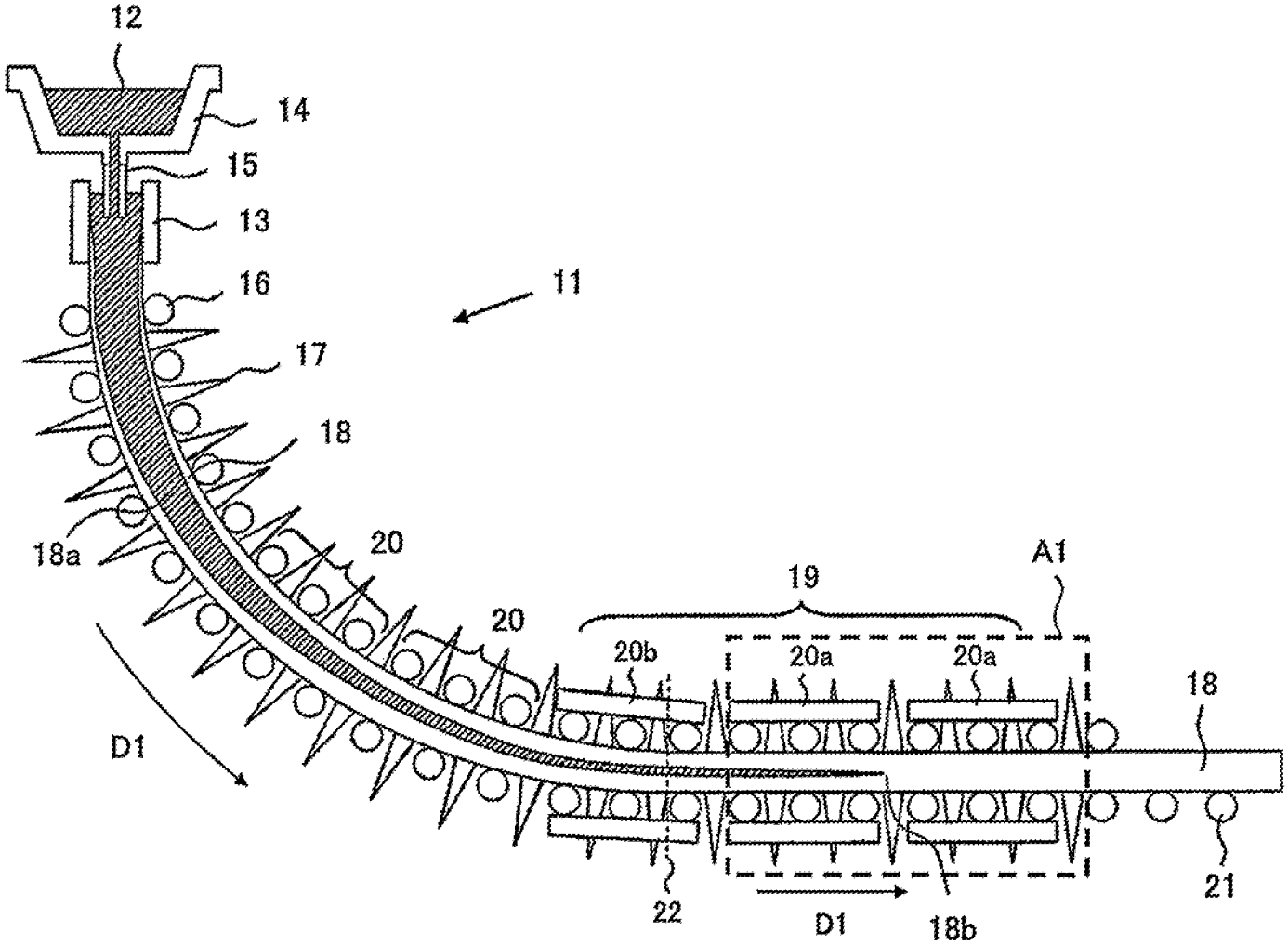
FIG. 1 is a schematic diagram illustrating an example of a continuous casting machine capable of employing a method for continuously casting steel according to the disclosed embodiments.

A preferred embodiment of the disclosed embodiments will be described below with reference to the drawings. Note that the scope of the disclosed embodiments is not limited to the examples illustrated in the drawings. In the present specification, the symbol "-" indicates a dimensionless number.

FIG. 1 is a schematic diagram illustrating an example of a continuous casting machine capable of employing a method for continuously casting steel according to the disclosed embodiments. A continuous casting machine 11 illustrated in FIG. 1 is a vertical-bending continuous casting machine. Note that the continuous casting machine 11 is not limited to a vertical-bending continuous casting machine, and a curved continuous casting machine may be used.

The continuous casting machine 11 illustrated in FIG. 1 includes a tundish 14, a mold 13, pairs of slab support rolls 16, a plurality of spray nozzles 17, and so forth. As illustrated in FIG. 1, a slab 18 is withdrawn in a slab withdrawal direction D1. In the present specification, the side on which the tundish 14 is disposed in the slab withdrawal direction D1 will be referred to as an upstream side, and the side to which the slab 18 is withdrawn will be referred to as a downstream side.

The tundish 14 is disposed above the mold 13 and supplies molten steel 12 to the mold 13. The molten steel 12 is supplied from a ladle (not illustrated) to the tundish 14 and stored in the tundish 14. A sliding nozzle (not illustrated) that adjusts the flow rate of the molten steel 12 is provided in the bottom of the tundish 14, and an immersion nozzle 15 is disposed on the lower surface of the sliding nozzle.

The mold 13 is disposed below the tundish 14. The molten steel 12 is injected into the mold 13 through the immersion nozzle 15 of the tundish 14. The injected molten steel 12 is cooled in the mold 13 (primary cooling), and as a result, an outer shell shape of the slab 18 is formed.

The pairs of slab support rolls 16 support the slab 18 from both sides of the slab 18 along the slab withdrawal direction D1. The pairs of slab support rolls 16 are formed of, for example, pairs of support rolls including a pair of support rolls, a pair of guide rolls, and a pair of pinch rolls. In addition, as illustrated in FIG. 1, the pairs of slab support rolls 16 are divided into groups each of which forms a single segment 20.

The plurality of spray nozzles 17 are arranged along the slab withdrawal direction D1 in such a manner that each of the spray nozzles 17 is provided between the adjacent slab support rolls 16. Each of the spray nozzles 17 is a nozzle for spraying a cooling water onto the slab 18 so as to subject the slab 18 to secondary cooling. As the spray nozzles 17, nozzles such as water spray nozzles (single-fluid nozzle nozzles) and air-mist spray nozzles (two-fluid nozzle nozzles) can be used without limitation.

The slab 18 is cooled by the cooling water (a secondary cooling water), which is sprayed from the plurality of spray nozzles 17, while being withdrawn in the slab withdrawal direction D1. Note that an unsolidified portion 18*a* of the molten steel in the slab 18 is illustrated as a shaded portion in FIG. 1. In addition, in FIG. 1, a reference sign 18*b* denotes a solidification completion position at which the unsolidified portion 18*a* has disappeared and solidification is completed.

In the continuous casting machine 11, a soft reduction zone 19 in which the slab 18 is subjected to soft reduction is located on the downstream side. The soft reduction zone 19 includes segments 20*a* and 20*b* each of which is formed of some pairs of the slab support rolls 16. The pairs of slab support rolls 16 in the soft reduction zone 19 are arranged in such a manner that the distance between each pair of rolls in the thickness direction of the slab 18 gradually becomes narrower in the slab withdrawal direction D1. As a result, the slab 18 that passes through the soft reduction zone 19 is subjected to soft reduction. In addition, in FIG. 1, a reference sign 22 denotes a lower straightening position of the continuous casting machine 11 that is set in the region of the soft reduction zone 19.

In the continuous casting machine 11, a region A1 of a horizontal zone in which the slab 18 is transported in the horizontal direction is located on the downstream side. Note that, in FIG. 1, one of the segments each of which is formed of some of the slab support rolls 16, the one segment being positioned in the region A1 of the horizontal zone, is denoted by a reference sign 20*a*, and another one of the segments that is positioned further upstream than the region A1 of the horizontal zone is denoted by a reference sign 20*b*.

In the continuous casting machine 11, a plurality of transport rolls 21 for transporting the slab 18 that has completely solidified are arranged further downstream than the region A1 of the horizontal zone. A slab cutting machine (not illustrated) for cutting the slab 18 into predetermined lengths is disposed above the transport rolls 21.

In the method for continuously casting steel according to the disclosed embodiments, in a section of the continuous casting machine 11 in the slab withdrawal direction D1, a section from a start point at which the average value of solid phase ratios along the thickness direction at the widthwise center of a slab is within a range of 0.4 or more and 0.8 or less to an end point at which the average value of solid phase ratios along the thickness direction at the widthwise center of the slab is greater than the average value of solid phase ratios at the start point and is 1.0 or less is set as a first section. Here, a solid phase ratio is an index that indicates the progress of solidification and is expressed in a range of 0 to 1.0. A solid phase ratio of 0 (zero) indicates unsolidification, and a solid phase ratio of 1.0 indicates complete solidification.

In the method for continuously casting steel according to the disclosed embodiments, in the first section, a slab is cooled by spraying water from water spray nozzles while the water flow rate per surface area of the slab is set within a range of 50 L/($m^2$×min) or more and 2,000 L/($m^2$×min) or less. As a result, the temperature gradient in a thicknesswise center portion of the slab becomes significantly large, and this causes refinement of the solidification microstructure of the thicknesswise center portion of the slab, so that center segregation is reduced. Here, in the present specification, cooling a slab by using a cooling water in the first section while the water flow rate per surface area of the slab is set within a range of 50 L/($m^2$×min) or more and 2,000 L/($m^2$×min) or less will hereinafter be referred to as "strong cooling".

The thickness direction at the widthwise center of a slab will now be described with reference to FIG. 2 and FIG. 3.

Figure 2:
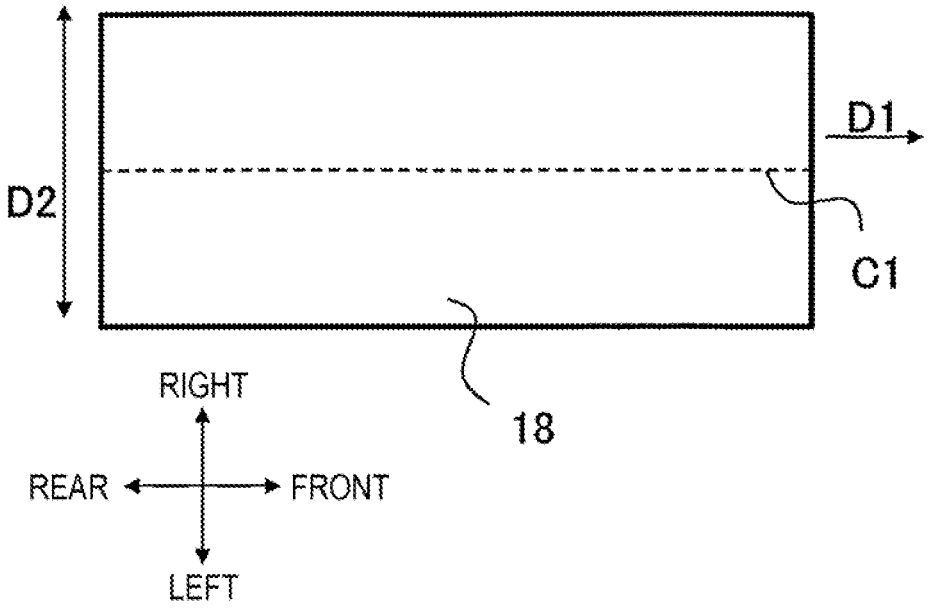
FIG. 2 is a plan view illustrating a position of the widthwise center of a slab.

FIG. 2 is a diagram illustrating a position C1 of the widthwise center of a slab. FIG. 2 is a plan view of the slab 18 when the upper surface and the lower surface of the slab 18 are supported by the slab support rolls 16. In FIG. 2, a forward direction that is indicated by "REAR←→FRONT", corresponds to the slab withdrawal direction D1, and the directions that are indicated by "RIGHT←→LEFT" each corresponds to a width direction D2 of the slab 18. The position C1 of the widthwise center of the slab is a position along the slab withdrawal direction D1 at the widthwise center of the slab 18 and is indicated by a dashed line in FIG. 2.

Figure 3:
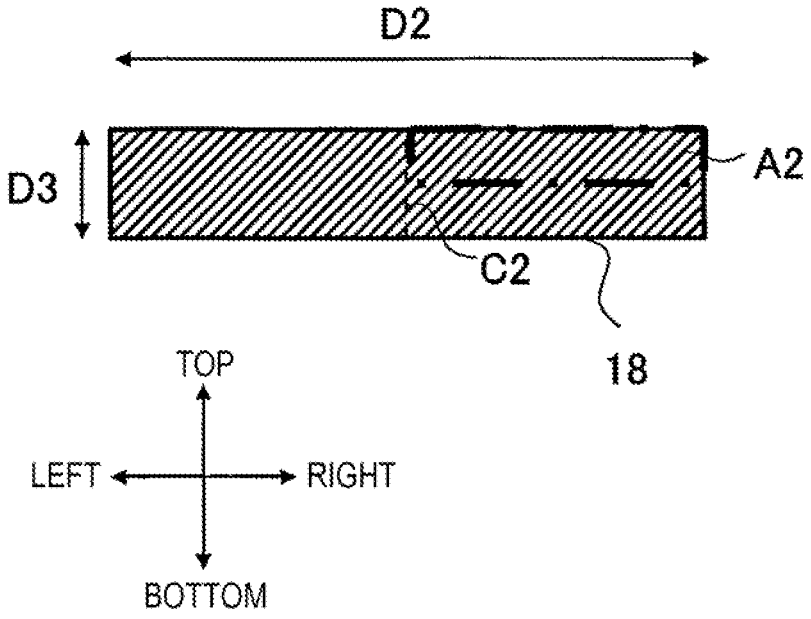
FIG. 3 is a cross-sectional view of the slab that is cut in a thickness direction at the position of the widthwise center.

FIG. 3 is a cross-sectional view of the slab 18 that is cut in a plane perpendicular to the slab withdrawal direction D1. In FIG. 3, the directions that are indicated by "LEFT←→RIGHT" each corresponds to a width direction D2 of the slab 18, and the directions that are indicated by "TOP←→BOTTOM", each correspond to a thickness direction D3 of the slab 18. In a cross section of the slab 18, a position C2 of the widthwise center of the slab in the thickness direction is a position parallel to the thickness direction D3 at the position C1 of the widthwise center of the slab and is indicated by a dashed line in FIG. 3.

<Solid Phase Ratio Along Thickness Direction at Widthwise Center of Slab>

The solid phase ratio along the thickness direction at the widthwise center of a slab can be calculated by using a temperature distribution in a cross section of the slab, a solidus temperature of molten steel, and a liquidus temperature of the molten steel in an analytical region A2 (see FIG. 3) of the cross section of the slab. Details of the method of calculating a solid phase ratio will be described later. When a cross section of the slab 18 obtained by cutting the slab 18 in a plane perpendicular to the slab withdrawal direction D1 is uniformly divided into four cross-sectional regions, the analytical region A2 is one of the four cross-sectional regions. As illustrated in FIG. 3, the four cross-sectional regions are obtained by uniformly dividing the cross section into two regions in the thickness direction of the slab and uniformly dividing the cross section into two regions in the width direction of the slab. In FIG. 3, the analytical region A2 is indicated by a one-dot chain line. Note that, in the present specification, the temperature of the slab is calculated on the assumption that the secondary cooling water is uniformly sprayed over the entire surface of the slab. Here, a solidus temperature is a temperature at which molten steel completely solidifies, that is, the temperature at which the solid phase ratio becomes 1.0, and a liquidus temperature is a temperature at which molten steel starts solidifying, that is, the temperature at which the solid phase ratio exceeds 0. A solidus temperature and a liquidus temperature are determined by the chemical composition of the molten steel.

<Temperature Distribution in Cross Section of Slab>

The temperature distribution in the cross section of the slab is obtained by performing unsteady heat transfer and solidification analysis on the analytical region A2. The unsteady heat transfer and solidification analysis can be performed by using a commonly known method. For example, in the unsteady heat transfer and solidification analysis, calculation can be performed by using, for example, the "enthalpy method" described in Publication 1 (written by Itsuo Ohnaka, Introduction to computational heat transfer and solidification analysis—Application to casting process, Maruzen Co., Ltd., 1985, pp. 201-202).

Figure 4:
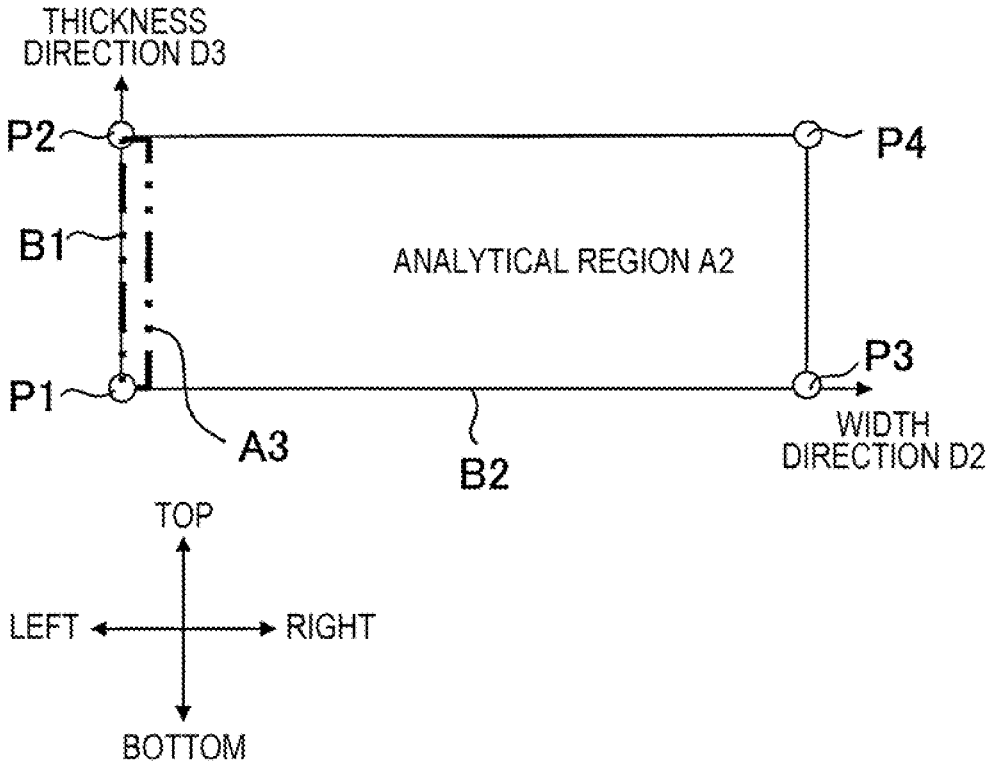
FIG. 4 is a diagram illustrating a region of the cross section of the slab that is to be subjected to analysis when a solid phase ratio along the thickness direction at the widthwise center of the slab is calculated.

FIG. 4 illustrates the analytical region A2. The vertices of the analytical region A2 correspond to a center position P1 in the cross section of the slab, a widthwise center position P2 on a surface of the slab, a thicknesswise center position P3 on a side surface of the slab, and a corner position P4 of the slab. In addition, in FIG. 4, regarding the boundaries between the analytical region A2 and the other regions, a boundary in the thickness direction and a boundary in the width direction are denoted by a reference sign B1 and a reference sign B2, respectively.

In the analytical region A2 of the cross section of the slab, boundary conditions are set as mirror conditions, and cooling conditions for the primary cooling and the secondary cooling are given as the boundary conditions to the boundary B1 and the boundary B2. In addition, for each cooling condition, a regression expression of a commonly known water-spray cooling method or a result measured by an experiment is used. The spatial mesh and the time mesh are suitably adjusted, and appropriate values are used.

A regression equation is used for the heat transfer coefficient in the case of cooling slab by spraying water on the surface of the slab, and physical property values corresponding to each temperature are obtained from a data book and used as the physical properties relating to other steel materials. For a temperature with no data, a value obtained by a proportional calculation using data items regarding temperatures before and after the temperature are used.

A heat transfer coefficient on a surface of a slab by a water spray is described in, for example, Publication 2 (Masashi Mitsuka, Iron and steel, Vol. 91, 2005, pp. 685-693, The Iron and Steel Institute of Japan) and Publication 3 (Toshio Teshima et al., Iron and steel, Vol. 74, 1988, pp. 1282-1289, The Iron and Steel Institute of Japan).

The temperature distribution in the cross section of the slab is calculated by using the following equation (1) in which a conversion temperature φ and a heat content H are introduced into a heat conduction equation.

[Math. 1]

$$\rho\frac{\partial H}{\partial \tau} = k_0\left(\frac{\partial^2 \phi}{\partial x^2} + \frac{\partial^2 \phi}{\partial y^2}\right) \tag{1}$$

In the above equation (1), ρ stands for a density of steel (kg/m$^3$), H stands for a heat content of steel (J/kg), τ stands for a length of time heat is transferred (sec), $k_0$ stands for a thermal conductivity at a reference temperature (J/(m×sec×° C.)), φ stands for a conversion temperature (° C.), x stands for a position (m) in an analytical region in the thickness direction of a slab, and y stands for a position (m) in the analysis area in the width direction of the slab.

Note that the reference temperature is a start temperature at the time of performing an integration operation for obtaining the conversion temperature and may be any temperature, and it is usually set to a room temperature or 0° C.

The conversion temperature is the product of the coefficient obtained by performing an integration operation of the ratio of the thermal conductivity from the reference temperature to the actual temperature and a true temperature θ. More specifically, for example, it is described in Publication 4 (The Iron and Steel Institute of Japan, heat economy technique committee, heating furnace subcommittee, Heat transfer experiment and calculation method in continuous steel slab heating furnace, 1971, The Iron and Steel Institute of Japan).

By performing the unsteady heat transfer and solidification analysis in the manner described above, the temperature distribution in the cross section of the slab can be obtained.

<Calculation of Average Value of Solid Phase Ratios Along Thickness Direction at Widthwise Center of Slab>

The average value of solid phase ratios along the thickness direction at the widthwise center of a slab is obtained by calculating the average value of solid phase ratios in a region A3 that is included in the two-dimensional cross section of the slab, which is the analytical region A2, and that extends in the thickness direction from the center in the width direction of the slab (the boundary B1 in FIG. 4) so as to have a width within a range of 10 mm. In FIG. 4, the region A3 is indicated by a two-dot chain line. The average value of solid phase ratios along the thickness direction at the widthwise center of the slab will hereinafter also be simply referred to as "average solid phase ratio".

The solid phase ratio at a certain position that is arbitrarily selected in the thickness direction of the cross section of the slab can be calculated by using the temperature at the arbitrarily selected position, the solidus temperature of molten steel, and the liquidus temperature of the molten steel. The temperature at the arbitrarily selected position can be determined by using the temperature distribution in the cross section of the slab, which has been mentioned above. When the temperature at the position is equal to or lower than the solidus temperature of the molten steel, the solid phase ratio is 1.0, and when the temperature at the position is equal to or higher than the liquidus temperature of the molten steel, the solid phase ratio is 0. In addition, when the temperature at the position is higher than the solidus temperature of the molten steel and lower than the liquidus temperature of the molten steel, the solid phase ratio is a value larger than 0 and smaller than 1.0 and is a predetermined solid phase ratio that is determined by the temperature at the position.

The average value of solid phase ratios along the thickness direction at the widthwise center of the slab is calculated from the solid phase ratios at the positions in the thickness direction of the slab calculated in the manner described above.

In the method for continuously casting steel according to the disclosed embodiments, in the first section, the water flow rate per surface area of a slab is set within a range of 50 L/($m^2$×min) or more and 2,000 L/($m^2$×min) or less. In order to efficiently obtain the effect of reducing segregation, in the first section, it is preferable to set the water flow rate per surface area of the slab to 300 L/($m^2$×min) or more. In addition, there is no significant difference in temperature gradient and in the number of segregated grains between the case where the water flow rate per surface area of the slab in the first section is set to 2,000 L/($m^2$×min) and the case where the water flow rate per surface area of the slab in the first section is set to 1,000 L/($m^2$×min). Furthermore, by reducing the water flow rate, the required amount of water is reduced, so that the costs can be reduced, and thus, it is preferable to set the water flow rate per surface area of the slab to 1,000 L/($m^2$×min) or less.

The advantageous effect of the disclosed embodiments can be obtained by cooling a slab in the first section at the water flow rate specified in the disclosed embodiments. From the standpoint of effectively obtaining the advantageous effect of the disclosed embodiments by increasing the length of the section in which cooling is performed at the above-mentioned water flow rate, it is preferable that the difference between the average solid phase ratio at the start point and the average solid phase ratio at the end point be 0.2 or more, and more preferably, 0.4 or more.

The start point of the first section is often located in the horizontal zone, in which a slab is transported in the horizontal direction in the continuous casting machine, or in a curved zone that is positioned further upstream than the horizontal zone. Here, it is preferable that the first section be located in the region A1 of the horizontal zone, in which a slab is transported in the horizontal direction in the continuous casting machine. By performing strong cooling in a region of the horizontal zone, a slab can be uniformly cooled, and the influence of thermal stress can be suppressed, so that the probability of occurrence of internal cracking of the slab can be further reduced.

Note that, even in the case where the start point of the first section is located in the curved zone, the advantageous effect of the disclosed embodiments can be obtained, and thus, the case where the start point of the first section is located in the curved zone is also within the scope of the disclosed embodiments.

When the average solid phase ratio at the end point of the first section is less than 1.0, a section that is positioned further downstream than the first section and that has a predetermined length is set as a second section.

In the second section, it is preferable to cool a slab by spraying water at the water flow rate per surface area of the slab smaller than the water flow rate per surface area of the slab in the first section. As a result, an advantageous effect in which the required amount of cooling water can be reduced by reducing the water flow rate more than that in the case of performing strong cooling only in the first section while segregation is reduced at a level similar to that in the case where strong cooling is performed only in the first section and an advantageous effect in which rapid reheat is suppressed so that internal cracking of the slab due to reheat is prevented from occurring can be obtained.

In addition, from the standpoint of effectively obtaining the above-mentioned advantageous effects, in the second section, it is preferable to cool a slab by spraying water while the water flow rate per surface area of the slab is set within a range of 50 L/($m^2$×min) or more and 300 L/($m^2$×min) or less.

In the second section, it is preferable that the surface temperature of the slab be 200° C. or lower. As a result, an advantageous effect in which internal cracking of the slab due to reheat is prevented from occurring and in which cooling is stabilized can be further effectively obtained.

In addition, it is preferable not to spray the secondary cooling water onto the slab in a section that is a region spaced apart by 5 m or more on the downstream side from the lower end of the mold of the continuous casting machine 11 along a slab withdrawal path line and that is a section extending at least 5 m or more toward the upstream side from a position between the pair of rolls adjacent to the upstream side of the start point of the first section. In other words, it is preferable to cool the slab by only bringing the slab into contact with the slab support rolls 16. In this case, when the full width of the slab is W (from −0.5 W through widthwise center 0 to +0.5 W), it is preferable that the difference between the maximum value and the minimum value of the surface temperature of the slab within a range of 0.8 W (from −0.4 W through widthwise center 0 to +0.4 W) of the width of the slab between the pair of rolls adjacent to the upstream side of the start point of the first section be 150° C. or less.

The surface temperature of the slab is the temperature at the widthwise center position P2 (see FIG. 4) on the outermost surface of the slab in the temperature distribution in the cross section of the slab obtained by the above-mentioned unsteady heat transfer and solidification analysis. Note that although this calculated value is used for the surface temperature in the disclosed embodiments, actual measurement of the surface temperature of the slab may be performed. In the case of performing actual measurement of the surface temperature, for example, the temperature of the outermost surface of the slab is measured as the surface temperature by using a radiation thermometer or a thermocouple.

EXAMPLES

First, studies were conducted on requirements for reduction of center segregation by using reference experiments. Next, conditions for reducing center segregation were examined in detail by using examples.

In Reference Experiments 1 to 4 and Examples 1 to 3, casting of medium carbon aluminum killed steel was performed by using the vertical-bending continuous casting machine illustrated in FIG. 1. The length of the continuous casting machine was 49 m. The thickness of a slab was 250 mm, and the width of the slab was 2,100 mm. In the secondary cooling, an air-mist spray was used in a region excluding the first section and the second section, and the area in which the secondary cooling was to be performed was set to an area extending from immediately below the mold to the exit of the continuous casting machine. The concentration of each chemical component of the medium carbon aluminum killed steel is as follows: 0.20% by mass of carbon (C), 0.25% by mass of silicon (Si), 1.1% by mass of manganese (Mn), 0.01% by mass of phosphorus (P), and 0.002% by mass of sulfur (S).

In Reference Experiments and Examples, a solidification completion position at which solidification of the slab is completed and the temperature gradient near the thicknesswise center of the slab at the end of solidification are defined as follows. In addition, the number of segregated grains in the slab and the length of an internal crack in the slab each of which was measured in the following manner are used in an evaluation of the degree of segregation and an evaluation of internal cracking, respectively.

<Solidification Completion Position>

The solidification completion position, at which solidification of the slab is completed, was calculated by the above-mentioned unsteady heat transfer and solidification analysis. More specifically, the above-mentioned temperature distribution in the cross section of the slab was calculated in the cross-section of the slab perpendicular to the slab withdrawal direction D1, and the position where all the temperatures in the region A3 (see FIG. 4) that extends in the thickness direction at the widthwise center of the slab were equal to or lower than the solidus temperature of the molten steel was defined as the solidification completion position.

<Temperature Gradient Near Thicknesswise Center of Slab at End of Solidification>

Figure 5:
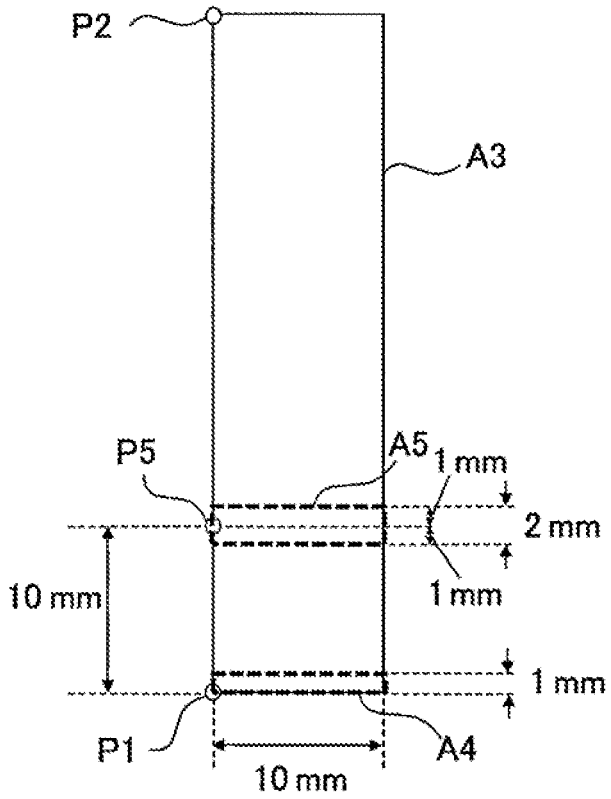
FIG. 5 is a diagram illustrating a region of the cross section of the slab that is used when a temperature gradient near a thicknesswise center at the end of solidification is calculated.

The temperature gradient near the thicknesswise center of the slab at the end of solidification was calculated by using the above-mentioned unsteady heat transfer and solidification analysis. Note that FIG. 5 is a diagram illustrating a region of the cross section of the slab (the cross section of the slab at a position 1 m upstream from the solidification completion position in the slab withdrawal direction D1) that was used when the temperature gradient near the thicknesswise center at the end of solidification was calculated.

More specifically, first, in the cross section of the slab at a position 1 m upstream from the solidification completion position in the slab withdrawal direction D1, the average temperature of a region (the region denoted by a reference sign A4 in FIG. 5) within a range of 1 mm in the thickness direction and 10 mm in the width direction from the center position P1 of the slab was calculated. Next, in the cross section of the slab at a position 1 m upstream from the solidification completion position in the slab withdrawal direction D1, the average temperature of a region (the region denoted by a reference sign A5 in FIG. 5) within a range of ±1 mm in the thickness direction and 10 mm in the width direction while a position P5 that is 10 mm away from the center position P1 of the slab in the thickness direction serves as the center was calculated. Then, the value obtained by dividing the difference between these two average temperatures by 10 mm was set as the temperature gradient near the thicknesswise center of the slab at the end of solidification (K/mm).

<Number of Segregated Grains>

The number of segregated grains was measured by the following method and used for the evaluation of segregation.

In the cross section of the slab perpendicular to the slab withdrawal direction D1, a slab sample having a width of 15 mm, including a center segregation portion in a center portion thereof, and having a length from the widthwise center to the triple point on one side (the point where the solidified shell on the short side and the solidified shell on the long side grew and met) was collected. A cross section of the collected slab sample, the cross section being perpendicular to the slab withdrawal direction D1, was polished, and the surface was corroded by, for example, an aqueous solution saturated with picric acid so as to cause a segregation zone to appear. An area within a range of ±7.5 mm of the thickness of slab from the center of the segregation zone was set as the center segregation portion. The slab sample in the segregation zone near the thicknesswise center (in the vicinity of a solidification completed portion) was subdivided in the width direction of the slab, and then an area analysis of the concentration of manganese (Mn) in the slab sample was performed over the entire surface of the slab sample by using an electron probe microanalyzer (EPMA) with an electron beam diameter of 100 μm. Then, the distribution of the degree of manganese (Mn) segregation was determined, and a single segregated grain was considered to be formed of continuous regions in each of which the degree of Mn segregation was 1.33 or more. The number of segregated grains was counted, and the value obtained by dividing the number of segregated grains by the length of the sample in the width direction of the slab was set as the number of segregated grains. Here, the degree of Mn segregation is obtained by dividing the concentration of Mn in the segregation portion by the concentration of Mn at a position 10 mm away from the thicknesswise center portion.

<Length of Internal Crack in Slab>

The lengths of internal cracks in the slab were measured by the following method and used for the evaluation of internal cracking.

In the slab that has undergone casting, the cross section of the slab perpendicular to the slab withdrawal direction D1 was observed, and the lengths of internal cracks along the thickness direction of the slab were measured. Among the lengths of these internal cracks, the longest length in the observed cross section was set as an internal crack length. In the case where no internal crack was observed, the internal crack length was set to zero.

The inventors of the disclosed embodiments conducted a large number of reference experiments in the following manner so as to examine conditions for reducing center segregation.

[Reference Experiment 1]

The temperature gradient near the thicknesswise center of the slab at the end of solidification and the number of segregated grains were calculated or measured by the above-mentioned method, and their relationship was examined. These measurement data items are shown in Table 1, and a graph plotting these data items is illustrated in FIG. 6.

TABLE 1

| Temperature Gradient [K/mm] | Number of Segregated grains [—/mm] |
|---|---|
| 0.65 | 6.94 |
| 0.94 | 4.27 |
| 1.50 | 2.50 |
| 1.96 | 2.22 |
| 2.61 | 1.09 |
| 3.14 | 1.30 |

Figure 6:
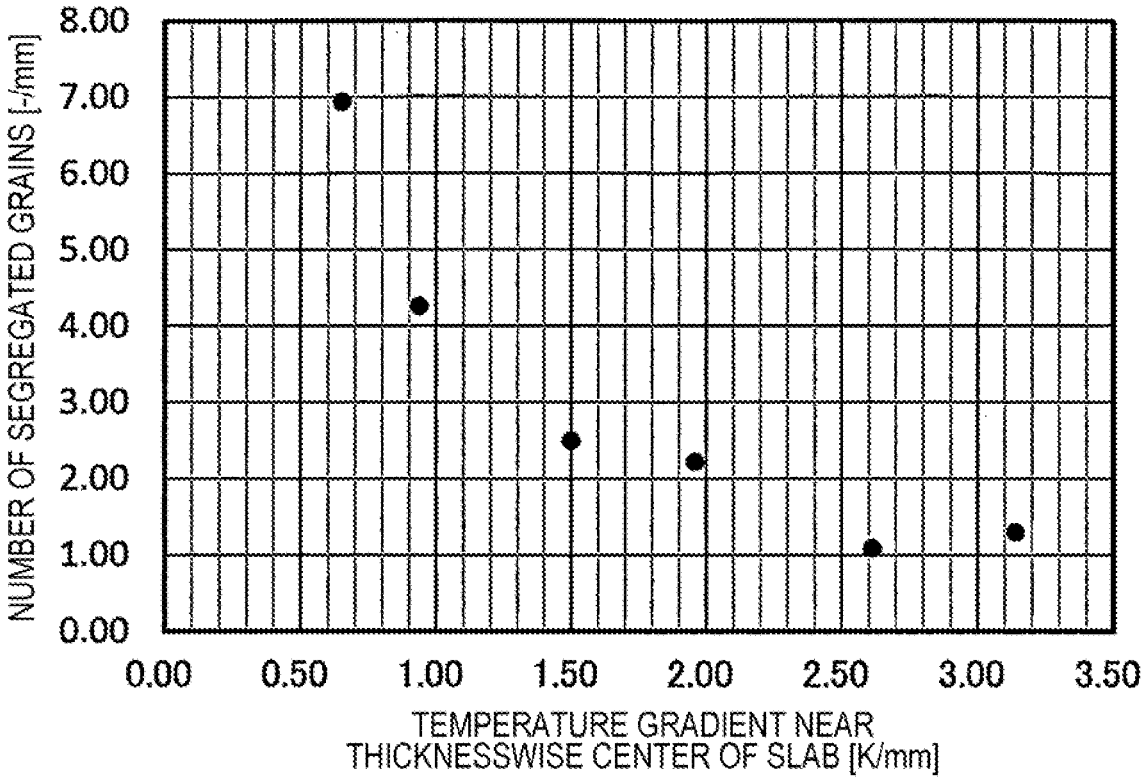
FIG. 6 is a graph illustrating a relationship between the temperature gradient and the number of segregated grains in Reference Experiment 1.

It was found from the results of Table 1 and FIG. 6 that, when the temperature gradient near the thicknesswise center at the end of solidification was increased, the number of center segregations was reduced, and it was likely that the center segregation can be reduced. It is assumed that the reduction of center segregation was achieved because refinement of the solidification microstructure of the thicknesswise center portion of the slab was achieved by increasing the temperature gradient.

[Reference Experiment 2]

A slab was manufactured by changing a condition of the water flow rate per surface area of the slab when water spraying was performed in the secondary cooling of the slab using a continuous casting machine, and the relationship between the water flow rate and the temperature gradient near the thicknesswise center of the slab at the end of solidification was examined. Then, the range of an optimum water flow rate for realizing the temperature gradient in the thicknesswise center portion of the slab with which the center segregation can be reduced was examined. These measurement data items are shown in Table 2, and a graph plotting these data items is illustrated in FIG. 7.

TABLE 2

| Water Flow Rate [L/m$^2$ · min)] | Temperature Gradient [K/mm] |
|---|---|
| 28 | 1.56 |
| 52 | 1.97 |
| 89 | 2.43 |
| 156 | 2.34 |
| 427 | 2.56 |
| 495 | 2.46 |
| 658 | 2.50 |
| 953 | 2.59 |
| 1,971 | 2.57 |
| 4,299 | 2.57 |

Figure 7:
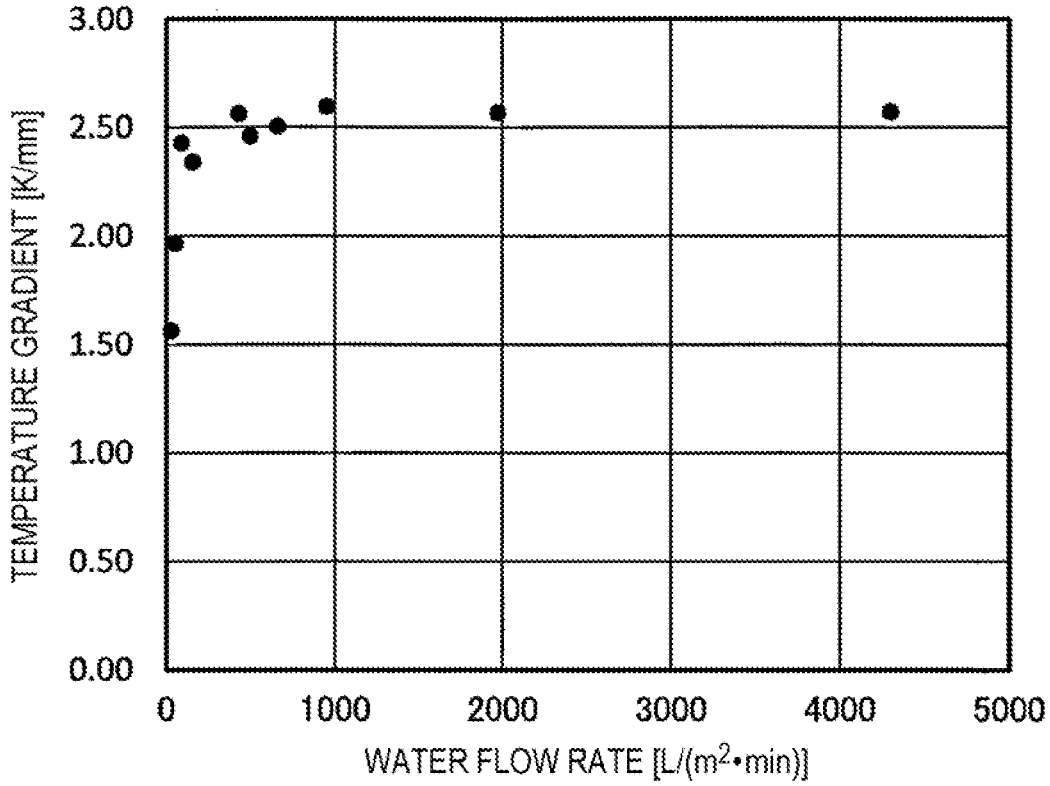
FIG. 7 is a graph illustrating a relationship between the water flow rate and the temperature gradient in Reference Experiment 2.

It was found from the results of Table 2 and FIG. 7 that the temperature gradient in the thicknesswise center portion of the slab became significantly large when the water flow rate per surface area of the slab was 50 L/(m$^2$×min) or more. In other words, according to the results of Reference Experiment 1, it was found that center segregation can be reduced to a large extent by performing cooling at a water flow rate per surface area of the slab of 50 L/(m$^2$×min) or more.

In addition, the temperature gradient did not increase by increasing the water flow rate per surface area of the slab to be greater than 500 L/(m$^2$×min). Therefore, it was found that it is preferable to set the water flow rate per surface area of the slab to 500 L/(m$^2$×min) or less in order to efficiently increase the temperature gradient.

[Reference Experiment 3]

The surface temperature of a slab has a great influence on the effect of cooling the slab. This is because the type of boiling of the cooling water changes depending on the surface temperature of the slab. When the surface temperature of the slab is sufficiently low, the type of boiling on a surface layer is nucleate boiling, and stable cooling can be performed.

Accordingly, the condition of the water flow rate per surface area of the slab in water spraying was changed when the second cooling was performed on the slab by using the continuous casting machine, and the time taken for the surface temperature of the slab to fall from 800° C. to 300° C. (a temperature fall time) was calculated so as to examine the influence of the water flow rate on the temperature fall time. These measurement data items are shown in Table 3, and a graph plotting these data items is illustrated in FIG. 8.

TABLE 3

| Water Flow Rate [L/m$^2$ · min)] | Temperature Fall Time [sec] |
|---|---|
| 28 | 208 |
| 52 | 180 |
| 156 | 155 |
| 270 | 128 |
| 300 | 100 |
| 404 | 70 |
| 495 | 62 |
| 658 | 51 |
| 953 | 43 |
| 1,971 | 24 |
| 4,299 | 26 |

Figure 8:
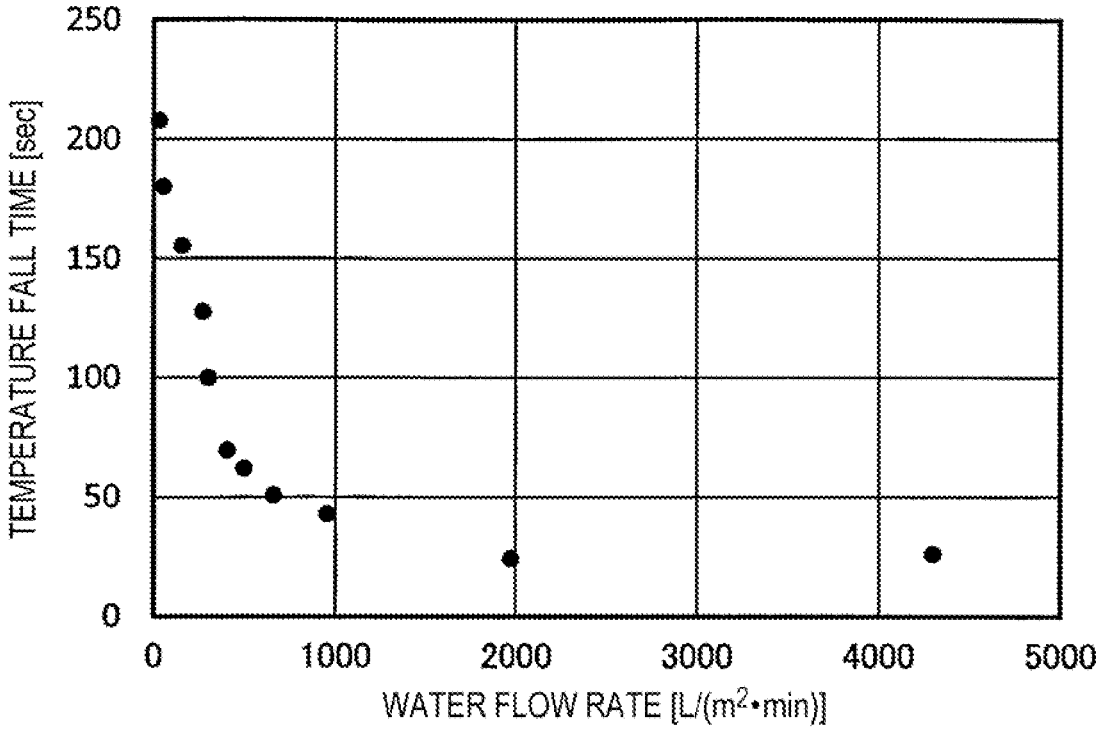
FIG. 8 is a graph illustrating a relationship between the water flow rate and the temperature fall time in Reference Experiment 3.

It was found from the results of Table 3 and FIG. 8 that when the water flow rate per surface area of the slab is around 50 L/(m$^2$×min), the temperature fall time taken for the surface temperature of the slab to fall from 800° C. to 300° C. is less than 200 seconds, which is shorter, and thus, it is preferable to set the water flow rate per surface area of the slab to 50 L/(m$^2$×min) or more. In addition, when the water flow rate per surface area of the slab was greater than 2,000 L/(m$^2$×min), there was no significant change in the fall time. Therefore, it was found that the water flow rate per surface area of the slab need to be set to 2,000 L/(m$^2$×min) or less from the standpoint of efficient cooling.

[Reference Experiment 4]

The inventors examined a start position of strong cooling by which the temperature gradient in the thicknesswise center portion of the slab can be efficiently increased.

Figure 9:
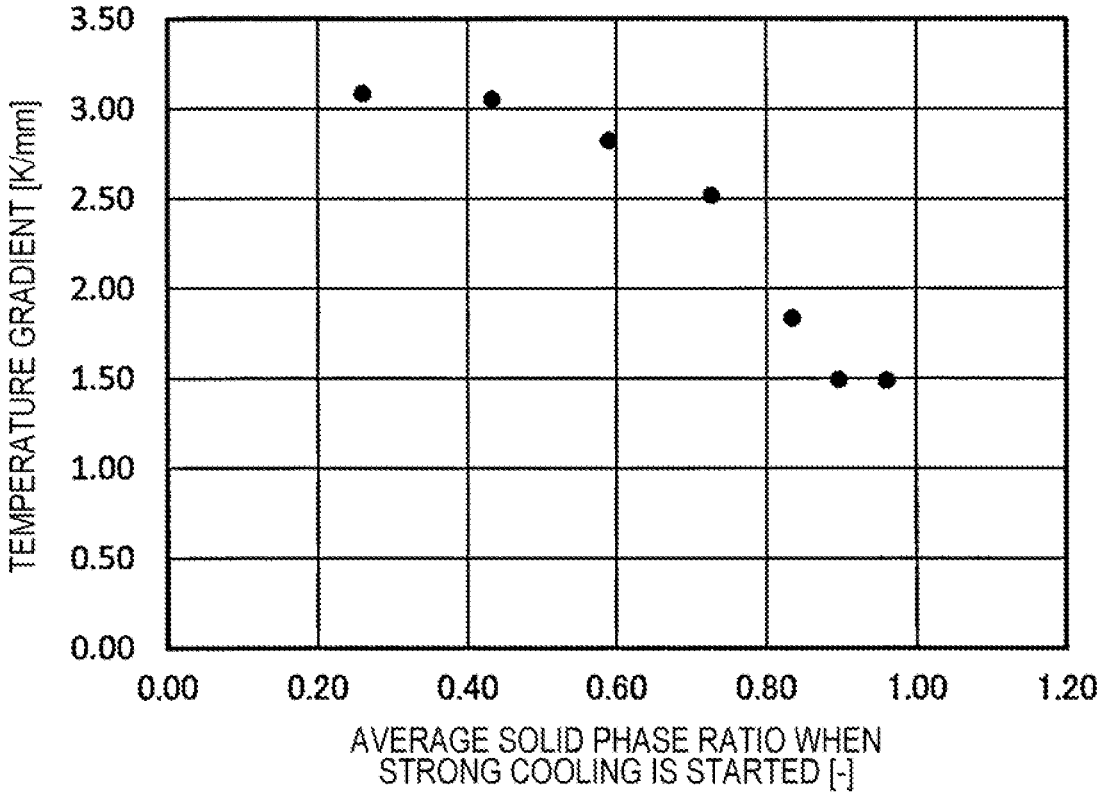
FIG. 9 is a graph illustrating a relationship between the solid phase ratio when strong cooling is started and the temperature gradient in Reference Experiment 4.

The slab was cooled by using a continuous casting machine while changing a condition of the average value of solid phase ratios along the thickness direction of the slab at the start of strong cooling, and the relationship between the average solid phase ratio at the start of strong cooling and the temperature gradient near the thicknesswise center of the slab at the end of solidification was examined. The thickness of the slab is 250 mm, and the water flow rate per surface area of the slab in the strong cooling is 300 L/(m$^2$×min). The strong cooling was continued until reaching a position where solidification of the slab was completed. The measurement data items relating to the relationship between the average solid phase ratio at the start of strong cooling and the temperature gradient near the thicknesswise center of the slab at the end of solidification are shown in Table 4, and a graph plotting these data items is illustrated in FIG. 9.

TABLE 4

| Average Solid Phase Ratio When Strong Cooling Is Started [—] | Temperature Gradient [K/mm] |
|---|---|
| 0.26 | 3.08 |
| 0.43 | 3.05 |
| 0.59 | 2.82 |
| 0.73 | 2.52 |
| 0.83 | 1.84 |

TABLE 4-continued

| Average Solid Phase Ratio When Strong Cooling Is Started [—] | Temperature Gradient [K/mm] |
|---|---|
| 0.90 | 1.49 |
| 0.96 | 1.49 |

It was found from the results of Table 1 and FIG. 6 that the temperature gradient in the center portion of the slab is likely to increase as the average solid phase ratio at the start of the strong cooling becomes smaller. However, there is no significant change between the temperature gradient when the average solid phase ratio at the start of the strong cooling is 0.26 and the temperature gradient when the average solid phase ratio at the start of the strong cooling is 0.43. Thus, it was found that, in order to sufficiently provide the advantageous effects of the disclosed embodiments and to reduce the size of the equipment for strong cooling so as to enhance the capital investment and the operational efficiency, the average solid phase ratio at the start of the strong cooling may be set to 0.4 or more. In addition, the temperature gradient did not increase when the average solid phase ratio at the start of the strong cooling was greater than 0.9.

Example 1

Steel continuous casting tests were conducted by variously changing the water flow rate per surface area of the slab when water was sprayed onto the slab in the secondary cooling as shown in Table 5. The average solid phase ratio at the start of strong cooling is 0.59. In addition, the strong cooling was performed until reaching the solidification completion position. Thus, the average solid phase ratio at the start point of the first section is 0.59, and the average solid phase ratio at the end point of the first section is 1.00. The strong cooling in Example 1 was performed in a region of the horizontal zone.

In addition, in each of the continuous casting tests, the temperature gradient in thicknesswise center portion of the slab at the end of solidification and the number of segregated grains in the slab were measured. Then, the degree of segregation was evaluated on the basis of the measured number of segregated grains. The measurement results are shown in Table 5.

TABLE 5

| | First Section | | | Temperature | Evaluation of Degree of Segregation | | |
|---|---|---|---|---|---|---|---|
| Test Number | Average Solid Phase Ratio at Start Point [—] | Average Solid Phase Ratio at End Point [—] | Water Flow Rate per Slab Surface Area [L/(m$^2$ · min)] | Gradient of Slab at End of Solidification [K/mm] | Number of Segregated Grains [—/mm] | Evaluation | Remark |
| 1-1 | 0.59 | 1.00 | 10 | 1.49 | 2.70 | X | Comparative Example |
| 1-2 | 0.59 | 1.00 | 30 | 1.26 | 3.12 | X | Comparative Example |
| 1-3 | 0.59 | 1.00 | 40 | 1.63 | 2.44 | X | Comparative Example |
| 1-4 | 0.59 | 1.00 | 50 | 2.27 | 1.81 | ○ | Example |
| 1-5 | 0.59 | 1.00 | 100 | 2.61 | 1.65 | ○ | Example |
| 1-6 | 0.59 | 1.00 | 300 | 2.69 | 1.40 | ⊙ | Example |
| 1-7 | 0.59 | 1.00 | 400 | 2.78 | 1.32 | ⊙ | Example |
| 1-8 | 0.59 | 1.00 | 500 | 2.73 | 1.26 | ⊙ | Example |
| 1-9 | 0.59 | 1.00 | 600 | 2.77 | 1.38 | ⊙ | Example |
| 1-10 | 0.59 | 1.00 | 1000 | 2.90 | 1.29 | ⊙ | Example |
| 1-11 | 0.59 | 1.00 | 1200 | 2.91 | 1.29 | ⊙ | Example |
| 1-12 | 0.59 | 1.00 | 1500 | 2.95 | 1.33 | ⊙ | Example |
| 1-13 | 0.59 | 1.00 | 2000 | 2.96 | 1.26 | ⊙ | Example |

The degree of segregation was evaluated on the basis of the following criteria.

⊙: The number of segregated grains is 1.40 or less

○: The number of segregated grains is greater than 1.40 and less than 2.30 x: The number of segregated grains is 2.30 or more

It was found from the results in Table 5 that center segregation that occurs in a slab can be reduced in the tests of the example according to the disclosed embodiments. More specifically, it was found that the center segregation that occurs in the slab can be reduced in the first section under a casting condition of a water flow rate per surface area of the slab of 50 L/(m$^2$×min) or more and 2,000 L/(m$^2$×min) or less.

Even when the water flow rate per surface area of the slab was set to 1,000 L/(m$^2$×min) or more, the number of segregated grains was not significantly improved. It was found that it is preferable to set the water flow rate per surface area of the slab within a range of 300 L/(m$^2$×min) or more and 1,000 L/(m$^2$×min) or less in order to effectively obtain the effect of reducing segregation.

Example 2

Continuous casting tests were conducted by variously changing the water flow rate per surface area of the slab when water was sprayed onto the slab in the secondary cooling, the average solid phase ratio at the start of strong cooling, and the average solid phase ratio at the end of strong cooling as shown in Table 6. The strong cooling in Example 2 was performed in a region of the horizontal zone.

In Test Number 2-1 of the comparative example, strong cooling was not performed, and accordingly, "Normal Cooling" is entered in the corresponding field in the first section column of Table 6. In addition, in Test Numbers 2-2 to 2-23, the average solid phase ratio at the start point of the first section was set to 0.4 or more by taking into consideration the results of Reference Experiment 4.

Considering these results, in the disclosed embodiments, the average solid phase ratio at the start point of the first section was set within a range of 0.4 or more and 0.8 or less. In addition, also in Test Numbers 2-21, 2-22, and 2-23 of the example according to the disclosed embodiments in each of which the average solid phase ratio at the end point of the first section was set to less than 1.0, a significant reduction of the number of segregated grains was achieved. It was found from this result that the average solid phase ratio at the end point of the first section may be less than 1.0.

TABLE 6

| | First Section | | | Temperature | Evaluation of Degree of Segregation | | |
|---|---|---|---|---|---|---|---|
| Test Number | Average Solid Phase Ratio at Start Point [—] | Average Solid Phase Ratio at End Point [—] | Water Flow Rate per Slab Surface Area [L/(m$^2$ · min)] | Gradient of Slab at End of Solidification [K/mm] | Number of Segregated Grains [—/mm] | Evaluation | Remark |
| 2-1 | Normal Cooling | Normal Cooling | 200 | 1.49 | 2.70 | X | Comparative Example |
| 2-2 | 0.43 | 1.00 | 500 | 3.05 | 1.23 | ⊙ | Example |
| 2-3 | 0.59 | 1.00 | 500 | 2.82 | 1.38 | ⊙ | Example |
| 2-4 | 0.73 | 1.00 | 500 | 2.52 | 1.43 | ○ | Example |
| 2-5 | 0.83 | 1.00 | 500 | 1.84 | 2.24 | ○ | Example |
| 2-6 | 0.90 | 1.00 | 500 | 1.49 | 2.58 | X | Comparative Example |
| 2-7 | 0.43 | 1.00 | 40 | 1.18 | 3.55 | X | Comparative Example |
| 2-8 | 0.43 | 1.00 | 50 | 2.88 | 1.29 | ⊙ | Example |
| 2-9 | 0.43 | 1.00 | 300 | 3.01 | 1.19 | ⊙ | Example |
| 2-10 | 0.43 | 1.00 | 2000 | 3.02 | 1.23 | ⊙ | Example |
| 2-11 | 0.75 | 1.00 | 40 | 1.51 | 2.73 | X | Comparative Example |
| 2-12 | 0.75 | 1.00 | 50 | 1.73 | 2.19 | ○ | Example |
| 2-13 | 0.75 | 1.00 | 300 | 1.81 | 2.18 | ○ | Example |
| 2-14 | 0.75 | 1.00 | 2000 | 1.84 | 2.14 | ○ | Example |
| 2-15 | 0.50 | 1.00 | 50 | 2.78 | 1.35 | ⊙ | Example |
| 2-16 | 0.75 | 1.00 | 50 | 1.73 | 2.29 | ○ | Example |
| 2-17 | 0.90 | 1.00 | 50 | 1.50 | 2.67 | X | Comparative Example |
| 2-18 | 0.50 | 1.00 | 2000 | 2.90 | 1.29 | ⊙ | Example |
| 2-19 | 0.75 | 1.00 | 2000 | 1.84 | 1.91 | ○ | Example |
| 2-20 | 0.90 | 1.00 | 2000 | 1.52 | 2.51 | X | Comparative Example |
| 2-21 | 0.43 | 0.59 | 500 | 2.95 | 1.25 | ⊙ | Example |
| 2-22 | 0.43 | 0.75 | 500 | 3.05 | 1.21 | ⊙ | Example |
| 2-23 | 0.59 | 0.75 | 500 | 2.78 | 1.35 | ⊙ | Example |

The degree of segregation was evaluated on the basis of criteria similar to those used in Example 1. It was found from the results in Table 6 that center segregation that occurs in a slab can be reduced in the tests of the example according to the disclosed embodiments.

As shown in Table 6, the number of segregated grains in Test Numbers 2-6, 2-17, and 2-20 of the comparative example in each of which the average solid phase ratio at the start point of the first section was set to 0.90 was approximately the same as that in Test Number 2-1 in which strong cooling was not performed. In contrast, in the tests of the example according to the disclosed embodiments in each of which the average solid phase ratio at the start point of the first section was set within a range of 0.4 or more and 0.8 or less, a significant reduction of the number of segregated grains was achieved.

Example 3

Continuous casting tests were conducted by variously changing the water flow rate per surface area of the slab in the first section and the water flow rate per surface area of the slab in the second section when water was sprayed onto the slab in the secondary cooling and the average solid phase ratios at the start point and the end point of each section as shown in Table 7. Note that, although the first section and the second section are not necessarily contiguous sections, the first section and the second section are contiguous sections in Example 3, and thus, the average solid phase ratio at the end point of the first section and the average solid phase ratio at the start point of the second section match each other.

TABLE 7

| Test Number | First Section: Average Solid Phase Ratio at Start Point [—] | First Section: Average Solid Phase Ratio at End Point [—] | First Section: Water Flow Rate per Slab Surface Area [L/(m$^2$ · min)] | Second Section: Average Solid Phase Ratio at Start Point [—] | Second Section: Average Solid Phase Ratio at End Point [—] | Second Section: Water Flow Rate per Slab Surface Area [L/(m$^2$ · min)] | Temperature Gradient at End of Solidification [K/mm] | Evaluation of Degree of Segregation: Number of Segregated Grains [—/mm] | Evaluation of Degree of Segregation: Evaluation | Maximum Surface Temperature in Second Section [° C.] | Evaluation of Internal Cracking: Length of Internal crack [mm] | Remark |
|---|---|---|---|---|---|---|---|---|---|---|---|---|
| 3-1 | 0.43 | 0.59 | 500 | 0.59 | 1.00 | 300 | 3.04 | 1.18 | ⊙ | 135 | 0 | Example |
| 3-2 | 0.43 | 0.75 | 500 | 0.75 | 1.00 | 300 | 3.05 | 1.15 | ⊙ | 135 | 0 | Example |
| 3-3 | 0.59 | 0.75 | 500 | 0.75 | 1.00 | 300 | 2.83 | 1.38 | ⊙ | 135 | 0 | Example |
| 3-4 | 0.43 | 0.59 | 500 | 0.59 | 0.75 | 300 | 2.90 | 1.29 | ⊙ | 135 | 0.8 | Example |
| 3-5 | 0.43 | 0.59 | 500 | 0.59 | 1.00 | 30 | 2.55 | 1.91 | ○ | 325 | 2.3 | Example |
| 3-6 | 0.43 | 0.59 | 500 | 0.59 | 1.00 | 40 | 2.61 | 1.89 | ○ | 255 | 2.1 | Example |
| 3-7 | 0.43 | 0.59 | 500 | 0.59 | 1.00 | 50 | 2.95 | 1.27 | ⊙ | 183 | 0.6 | Example |
| 3-8 | 0.43 | 0.59 | 500 | 0.59 | 1.00 | 150 | 3.04 | 1.24 | ⊙ | 148 | 0 | Example |
| 3-9 | 0.43 | 0.59 | 500 | 0.59 | 1.00 | 300 | 3.06 | 1.23 | ⊙ | 135 | 0 | Example |
| 3-10 | 0.43 | 1.00 | 500 | — | — | — | 3.05 | 1.23 | ⊙ | — | 0 | Example |

The degree of segregation was evaluated on the basis of criteria similar to those used in Example 1. It was found from the results in Table 7 that center segregation that occurs in a slab can be reduced in the tests of the example according to the disclosed embodiments.

In the test of the example according to the disclosed embodiments in each of which the water flow rate per surface area of the slab in the second section is set to 50 L/(m$^2$×min) or more and 300 L/(m$^2$×min) or less, a significant reduction of the number of segregated grains was achieved. It was found from these results that it is preferable to set the water flow rate in the second section to 50 L/(m$^2$×min) or more and 300 L/(m$^2$×min) or less.

In addition, in Test Number 3-5 in which the water flow rate in the second section was set to 30 L/(m$^2$×min) and Test Number 3—in which the water flow rate in the second section was set to 40 L/(m$^2$×min), the temperature of the surface layer was increased to 200° C. in the second section, that is, reheat occurred, and a small amount of internal cracking occurred due to this reheat. In contrast, in the tests of the example according to the disclosed embodiments in each of which the water flow rate per surface area of the slab in the second section was set to 50 L/(m$^2$×min) or more and 300 L/(m$^2$×min) or less, reheat that was large enough to cause the surface temperature to reach 200° C. or higher did not occur in the second section, and almost no internal cracking occurred. It was found from these results that it is preferable that the surface temperature of the slab in the second section be 200° C. or lower.

In Test Number 3-4 in which the average solid phase ratio at the end point of the second section was set to less than 1.0, although the number of segregated grains was reduced, reheat occurred downstream from the second section, and a negligible amount of internal cracking occurred due to this reheat. Therefore, it was found that it is preferable that the average solid phase ratio at the end point of the second section be 1.0 and that the surface temperature of the slab at the position where solidification of the slab is completed be 200° C. or lower.

Example 4

Figure 10:
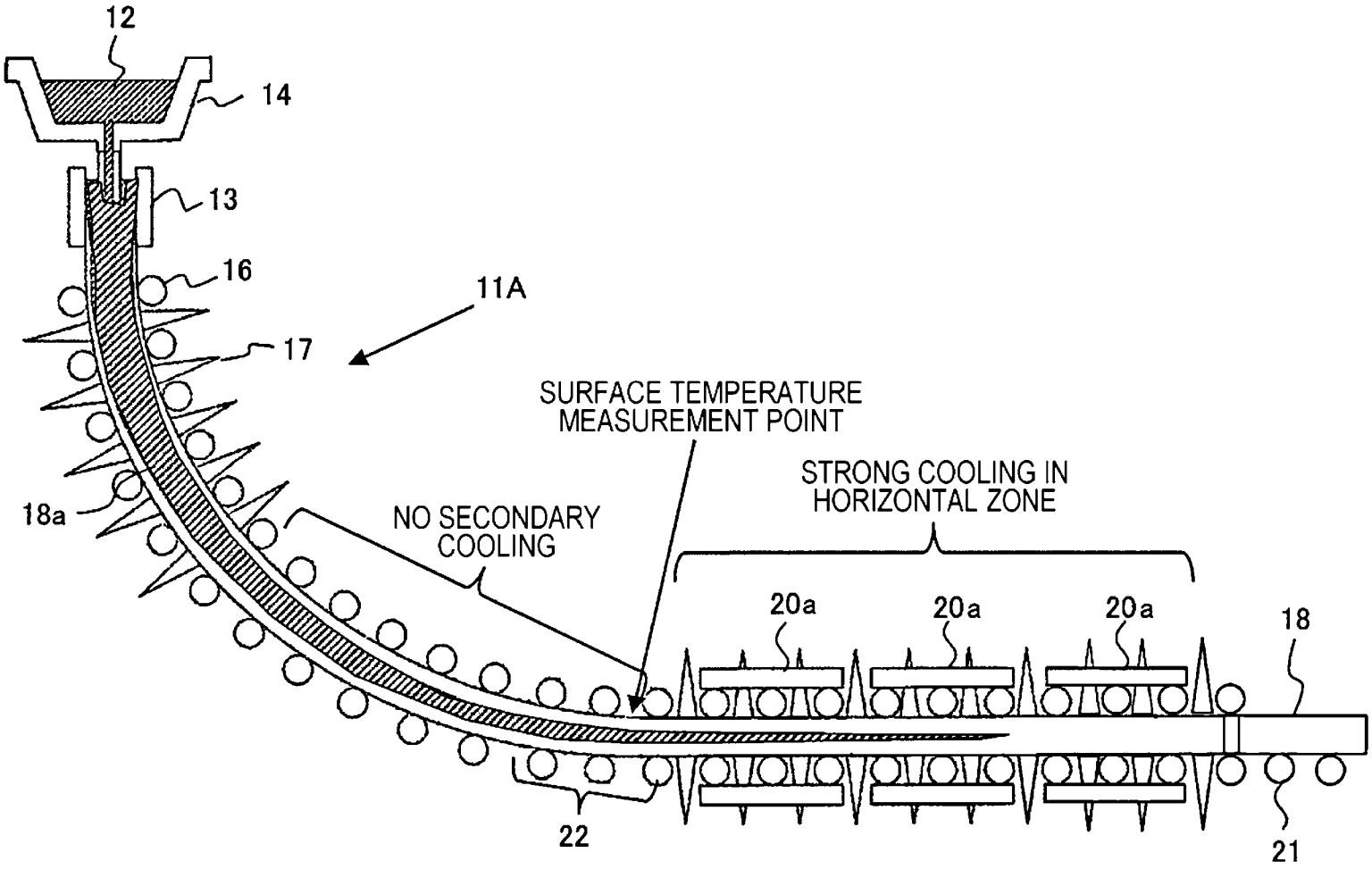
FIG. 10 is a schematic diagram illustrating another example of the continuous casting machine capable of employing the method for continuously casting steel according to the disclosed embodiments.

FIG. 10 is a schematic diagram illustrating another example of the continuous casting machine capable of employing the method for continuously casting steel according to the disclosed embodiments. Although a continuous casting machine 11A illustrated in FIG. 10 is basically similar to the continuous casting machine illustrated in FIG. 1, the difference from the continuous casting machine illustrated in FIG. 1 is that, in a predetermined section that is located further upstream than a position between the pair of rolls adjacent to the upstream side of the start point of the first section, a slab is cooled by only bringing the slab into contact with the slab support rolls (hereinafter referred to as "roll cooling") without spraying the secondary cooling water onto the slab. In Example 4, the vertical-bending continuous casting machine illustrated in FIG. 10 was used.

The slab support rolls that are arranged in the section in which the roll cooling is performed can be arbitrarily designed by taking into consideration their durability and so forth as long as they have a structure in which a cooling water flows through the inside of the rolls. Continuous casting tests were conducted, and in the tests, strong cooling was performed, in the horizontal zone, on the slab that has passed through the section in which only the roll cooling is performed. Although the case has been described as an example in which the water flow rate in the first section and the water flow rate in the second section were respectively set to 500 L/(m$^2$×min) and 150 L/(m$^2$×min) as the strong cooling conditions, it has been confirmed that similar results are obtained as long as each water flow rate is within the scope of the disclosed embodiments.

A list of the test results is shown in Table 8.

TABLE 8

| Test Number | Section with No Secondary Cooling Water: Length of Section with No Secondary Cooling Water [m] | Section with No Secondary Cooling Water: Widthwise Temperature Variations of Slab [° C.] | First Section: Average Solid Phase Ratio at Start Point [—] | First Section: Average Solid Phase Ratio at End Point [—] | First Section: Water Flow Rate per Slab Surface Area [L/(m$^2$ · min)] | Second Section: Average Solid Phase Ratio at Start Point [—] | Second Section: Average Solid Phase Ratio at End Point [—] |
|---|---|---|---|---|---|---|---|
| 4-1 | 0 | 184 | 0.62 | 0.78 | 500 | 0.78 | 1.00 |
| 4-2 | 2.5 | 162 | 0.60 | 0.76 | 500 | 0.76 | 1.00 |
| 4-3 | 5.0 | 146 | 0.59 | 0.75 | 500 | 0.75 | 1.00 |
| 4-4 | 7.5 | 141 | 0.57 | 0.73 | 500 | 0.73 | 1.00 |
| 4-5 | 10 | 133 | 0.52 | 0.68 | 500 | 0.68 | 1.00 |
| 4-6 | 15 | 126 | 0.50 | 0.66 | 500 | 0.66 | 1.00 |
| 4-7 | 20 | 115 | 0.46 | 0.62 | 500 | 0.62 | 1.00 |
| 4-8 | 25 | 102 | 0.42 | 0.58 | 500 | 0.58 | 1.00 |

| Test Number | Second Section Water: Flow Rate per Slab Surface Area [L/(m$^2$ · min)] | Temperature: Gradient of Slab at End of Solidification [K/mm] | Evaluation of Degree of Segregation: Number of Segregated Grains [—/mm] | Evaluation of Degree of Segregation: Evaluation | Evaluation of Internal Cracking: Length of Internal crack [mm] | Remark |
|---|---|---|---|---|---|---|
| 4-1 | 150 | 3.03 | 1.23 | ⊙ | 0 | Example |
| 4-2 | 150 | 3.04 | 1.24 | ⊙ | 0 | Example |
| 4-3 | 150 | 3.01 | 1.13 | ⊙ | 0 | Example |
| 4-4 | 150 | 3.05 | 1.11 | ⊙ | 0 | Example |
| 4-5 | 150 | 3.03 | 1.09 | ⊙ | 0 | Example |
| 4-6 | 150 | 3.02 | 1.12 | ⊙ | 0 | Example |
| 4-7 | 150 | 3.06 | 1.11 | ⊙ | 0 | Example |
| 4-8 | 150 | 3.05 | 1.10 | ⊙ | 0 | Example |

Here, in Table 8, "Length of Section with No Secondary Cooling Water" is the length of a section in which the secondary cooling water is not used, the section extending from the start point at which the secondary cooling water is not used to the position between the pair of rolls adjacent to the upstream side of the start point of the first section. Note that it is preferable that the section in which the secondary cooling water is not used be positioned 5 m downstream from the lower end of the mold. This is because, if the secondary cooling water is not used in an area 5 m upstream from the lower end of the mold, operational instability such as breakout due to insufficient growth of a solidified shell may be caused.

In the column "Widthwise Temperature Variations of Slab", the difference between the maximum value and the minimum value of the surface temperature of the slab within the range of 0.8 W (from −0.4 W through widthwise center 0 to +0.4 W) of the width of the slab with respect to the full width W of the slab (from −0.5 W through widthwise center 0 to +0.5 W) when the surface temperature of the slab in the width direction is measured at a position between the pair of rolls adjacent to the upstream side of the start point of the first section is entered (the greatest difference value among measured difference values obtained under the same casting conditions is entered).

Figure 11:
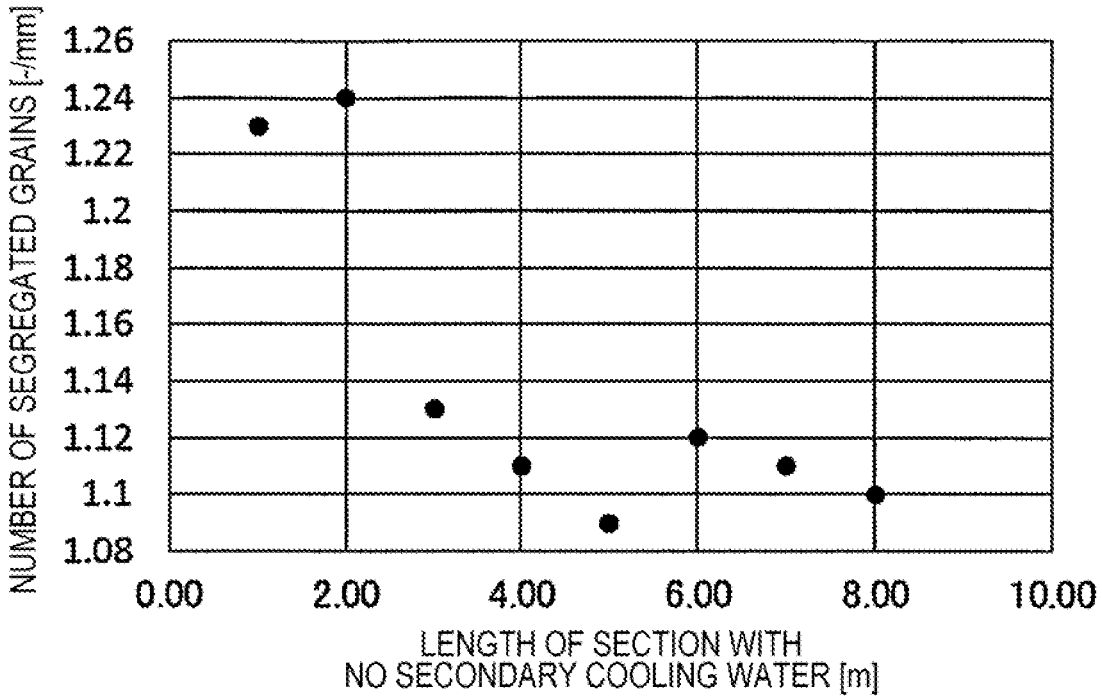
FIG. 11 is a graph illustrating a relationship between the length of a section in which a secondary cooling water is not used and the number of segregated grains.

FIG. 11 illustrates the relationship between the length of the section in which the secondary cooling water is not used and the number of segregated grains. As seen from Test Numbers 4-1 and 4-2, when the length of the section in which the secondary cooling water is not used is less than 5 m, the widthwise temperature variations of the slab are large.

In contrast, when the length of the section in which the secondary cooling water is not used is 5 m or more as in Test Numbers 4-3 to 4-8, the widthwise temperature variations of the slab are 150° C. or lower. As a result, although there is no significant difference in the temperature gradient near the thicknesswise center portion of the slab, occurrence of variations in segregation in the width direction of the slab is suppressed, and thus, a reduction of the number of segregated grains was achieved.

REFERENCE SIGNS LIST

11 continuous casting machine
11A continuous casting machine
12 molten steel
13 mold
14 tundish
15 immersion nozzle
16 slab support roll
17 spray nozzle
18 slab
18*a* unsolidified portion in slab
18*b* solidification completion position
19 soft reduction zone
20 segment
20*a* segment
20*b* segment
21 transport roll

The invention claimed is:

1. A method for continuously casting steel, the method comprising:

withdrawing a slab along a slab withdrawal direction in a continuous casting machine; and in a first section of the continuous casting machine in the slab withdrawal direction, cooling the slab with water at a water flow rate per surface area of the slab within a range of 300 L/($m^2$×min) or more and 2,000 L/($m^2$×min) or less, wherein the first section extends from a start point at which an average value of solid phase ratios along a thickness direction of the slab at a widthwise center of the slab is within a range of 0.4 or more and 0.8 or less to an end point at which an average value of solid phase ratios along the thickness direction at the widthwise center of the slab is greater than the average value of solid phase ratios at the start point and is 1.0 or less.

2. The method for continuously casting steel according to claim 1, further comprising:

in a second section of the continuous casting machine in the slab withdrawal direction, cooling the slab with water at a water flow rate per surface area of the slab that is smaller than the water flow rate per surface area of the slab in the first section, wherein:

the average value of solid phase ratios at the end point of the first section is less than 1.0, and the second section has a predetermined length and is positioned further downstream than the first section.

3. The method for continuously casting steel according to claim 2, wherein the slab is cooled with water in the second section at a water flow rate per surface area of the slab within a range of 50 L/($m^2$×min) or more and 300 L/($m^2$×min) or less.

4. The method for continuously casting steel according to claim 2, wherein, in the second section, a surface temperature of the slab is 200° C. or lower.

5. The method for continuously casting steel according to claim 1, wherein the first section is located in a region of a horizontal zone in which the slab is transported in a horizontal direction in the continuous casting machine.

6. The method for continuously casting steel according to claim 1, further comprising, in a section that is a region spaced apart by 5 m or more on the downstream side from a lower end of a mold of the continuous casting machine along a slab withdrawal path line and that is a section extending at least 5 m or more toward an upstream side from a position between rolls adjacent to an upstream side of the start point of the first section, cooling the slab without spraying a secondary cooling water onto the slab, wherein, when a full width of the slab is W, from −0.5 W through widthwise center 0 to +0.5 W, a difference between a maximum value and a minimum value of a surface temperature of the slab within a range of 0.8 W, from −0.4 W through widthwise center 0 to +0.4 W, of the width of the slab between the rolls adjacent to the upstream side of the start point of the first section is 150° C. or less.

7. The method for continuously casting steel according to claim 1, wherein the average value of solid phase ratios at the end point of the first section is 1.0.

8. The method for continuously casting steel according to claim 1, further comprising, in a section of the continuous casting machine in the slab withdrawal direction that is adjacent to an upstream side of the start point of the first section, cooling the slab without spraying a secondary cooling water onto the slab.

* * * * *